United States Patent [19]

Schrager

[11] Patent Number: 4,763,427

[45] Date of Patent: Aug. 16, 1988

[54] GREETING CARD

[75] Inventor: Rodney Schrager, London, England

[73] Assignee: Second Nature Limited, London, England

[21] Appl. No.: 824,058

[22] Filed: Jan. 30, 1986

[30] Foreign Application Priority Data

Jan. 30, 1985 [GB] United Kingdom ..... 8502256

[51] Int. Cl.[4] ..... G09F 1/00

[52] U.S. Cl. ..... 40/124.1; 40/539

[58] Field of Search ..... 40/539, 124.1; 446/148, 446/150

[56] References Cited

U.S. PATENT DOCUMENTS

| | | | |
|---|---|---|---|
| 1,359,203 | 11/1920 | Stranders | 40/539 |
| 2,099,420 | 11/1937 | Cloud | 40/539 |
| 2,147,132 | 2/1939 | Ziemmerman | 40/124.1 |
| 2,187,721 | 1/1940 | Wolfson | 40/124.1 |
| 2,601,374 | 6/1952 | Ditzler et al. | 40/539 |
| 3,091,877 | 6/1963 | Luchsinger | 40/124.1 |
| 3,267,597 | 8/1966 | Jannes | 40/124.1 |
| 3,721,029 | 3/1973 | Austin | 40/124.1 |

FOREIGN PATENT DOCUMENTS

| | | | |
|---|---|---|---|
| 110847 | 11/1917 | United Kingdom | 40/124.1 |
| 436279 | 9/1935 | United Kingdom | 40/539 |
| 565701 | 11/1944 | United Kingdom | 40/539 |
| 621433 | 4/1949 | United Kingdom | 40/539 |
| 808856 | 2/1959 | United Kingdom | 40/539 |

*Primary Examiner*—Robert P. Swiatek
*Assistant Examiner*—Cary E. Stone
*Attorney, Agent, or Firm*—Christie, Parker & Hale

[57] ABSTRACT

A greeting card comprising at least one lamina having portions which are foldable with respect to each other and an elastic band (22) for urging the portions of a folded the lamina from a first relative position in which the portions are contiguously disposed in adjacent planes into a second relative position in which the portions are disposed in mutually transverse planes and a first array (24) of the portions defines a display surmounting, and extending 3-dimensionally from, a second array (25) of the portions which defines a plinth for the first array. An auxiliary lamina (21) is provided to facilitate the insertion of the rubber band (22); it also contributes to the display (24).

13 Claims, 5 Drawing Sheets

GREETING CARD

CROSS REFERENCES TO RELATED APPLICATION

This application discloses common subject matter to U.S. application Ser. No. 760,663, filed July 30, 1985.

This invention relates to a greeting card of the kind comprising resilient means for urging a portion of the card to spring from a first position relative to another portion of the card into a second such relative position upon withdrawal of the card from an envelope.

The object of the present invention is to provide such a greeting card which is more spectacular than cards of the aforesaid kind presently available and which is capable of giving the recipient of such a card a greater surprise and greater pleasure when withdrawing it from its envelope than presently available such greeting cards.

According to the invention, a greeting card comprises a lamina having portions which are foldable with respect to each other and rsilient means for urging said portions of a folded said lamina from a first relative position in which said portions are contiguously disposed in adjacent planes into a second relative position in which said portions are disposed in mutually transverse planes and a first array of said portions defines a display surmounting, and extending three-dimensionally from, a second array of said portions which defines a plinth for said first array.

Preferably the greeting card embodying the invention includes a second lamina having portions which are foldable with respect to each other, said second lamina being secured to said first-mentioned lamina so that, in said first relative position of said portions of said first-mentioned lamina, said portions of said second lamina are folded so that said last-mentioned portions are disposed in a first relative position in which they are contiguously disposed in adjacent planes and, in said second relative position of the portions of said first-mentioned lamina, said portions of said second lamina are urged by said resilient means, directly or via at least one portion of said first-mentioned lamina into a second relative position in which said portions of said second lamina define a second display which extends three-dimensionally from the display defined by said array of said portions of said first-mentioned lamina.

The invention also includes within its scope, as the case may be, a said lamina or a said lamina and a said second lamina for use in a greeting card embodying the invention as hereinbefore defined, and also, as the case may be, a blank or blanks for said lamina or laminae.

Two forms of greeting card embodying the invention will now be described by way of example with reference to the accompanying drawings in which.

Figure 3:
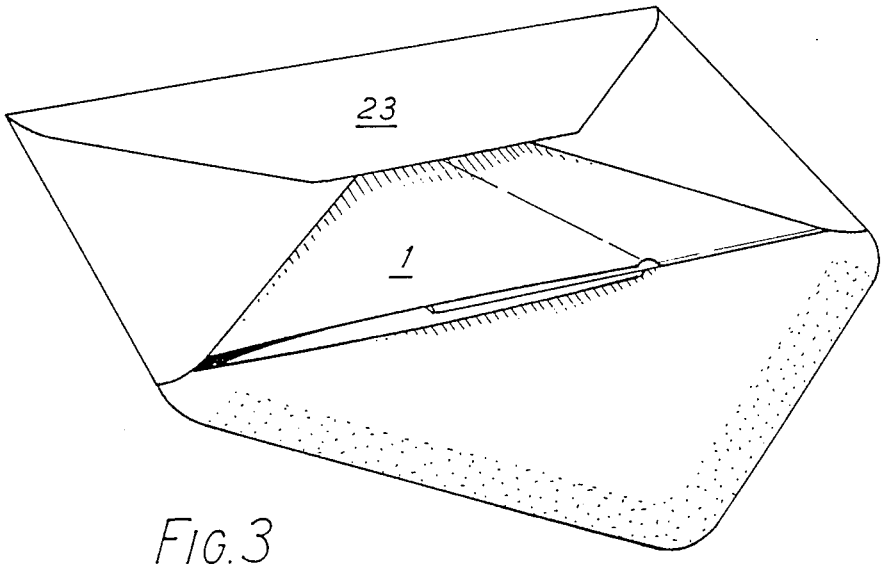
FIG. 3 shows the blanks of FIGS. 1 and 2 folded with portions thereof in said first relative position and with the greeting card positioned inside an envelope.
Figure 4:
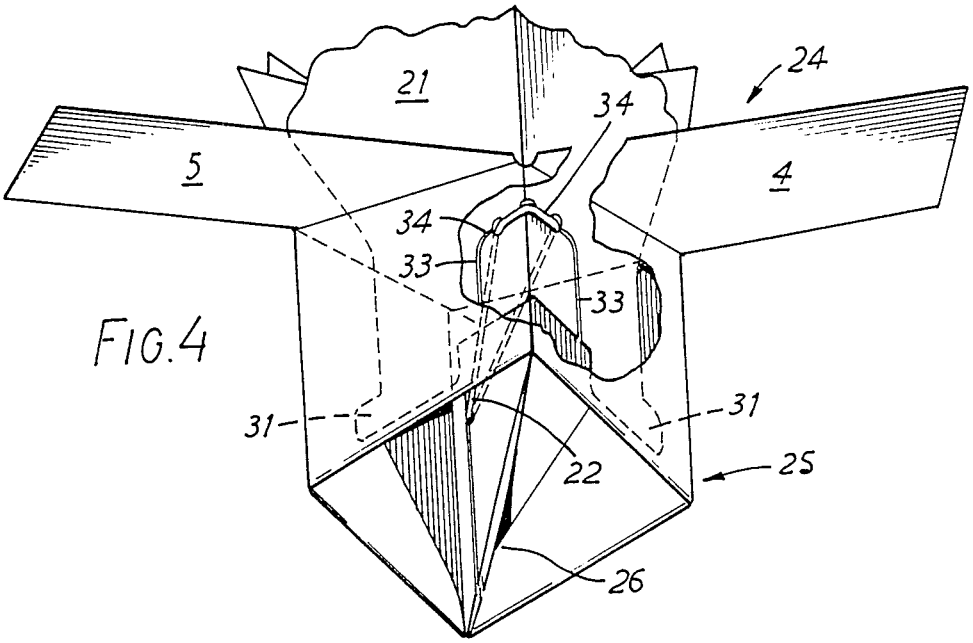
FIG. 4 is a partly broken away perspective view from below of the blank of FIGS. 1 to 3 with said portions urged by said resilient means into said second relative position.

Referring firstly to FIGS. 1 to 4, said first form of greeting card comprises: a lamina, a blank of which is generally designated 1, having portions 2 to 19 which are foldable with respect to each other about fold lines such as 20 between adjacent said portions; an auxiliary lamina, a blank of which is generally designated 21 (FIG. 2); and resilient means in the form of an elastic rubber band 22 (FIG. 4).

The rubber band 22 is attached to appropriate said portions of the blanks 1 and 21 for resiliently urging said portions of said blanks 1 and 21 when folded in the manner shown in FIG. 3 (in which said portions are contiguously disposed in adjacent planes) into their position as shown in FIG. 4 (in which said portions are disposed in mutually transverse planes).

In the position of the portions 2 to 19 shown in FIG. 3, the rubber band 22 is in a state of tension and the greeting card is retained in the condition shown in FIG. 3 by a reaction force exerted on the greeting card by the walls of an envelope 23, the force being opposite to the force exerted on the greeting card by the rubber band 22.

Upon removal of the greeting card from the envelope 23, the said reaction force is removed, with the result that the said portions 2 to 19 take up their respective positions shown in FIG. 4.

A first array of said portions (viz. portions 2 to 7) defines a display 24 surmounting, and extending three-dimensionally from, a second array of said portions (viz. portions 8 to 19) which defines a plinth 25 for said first array.

Figure 1:
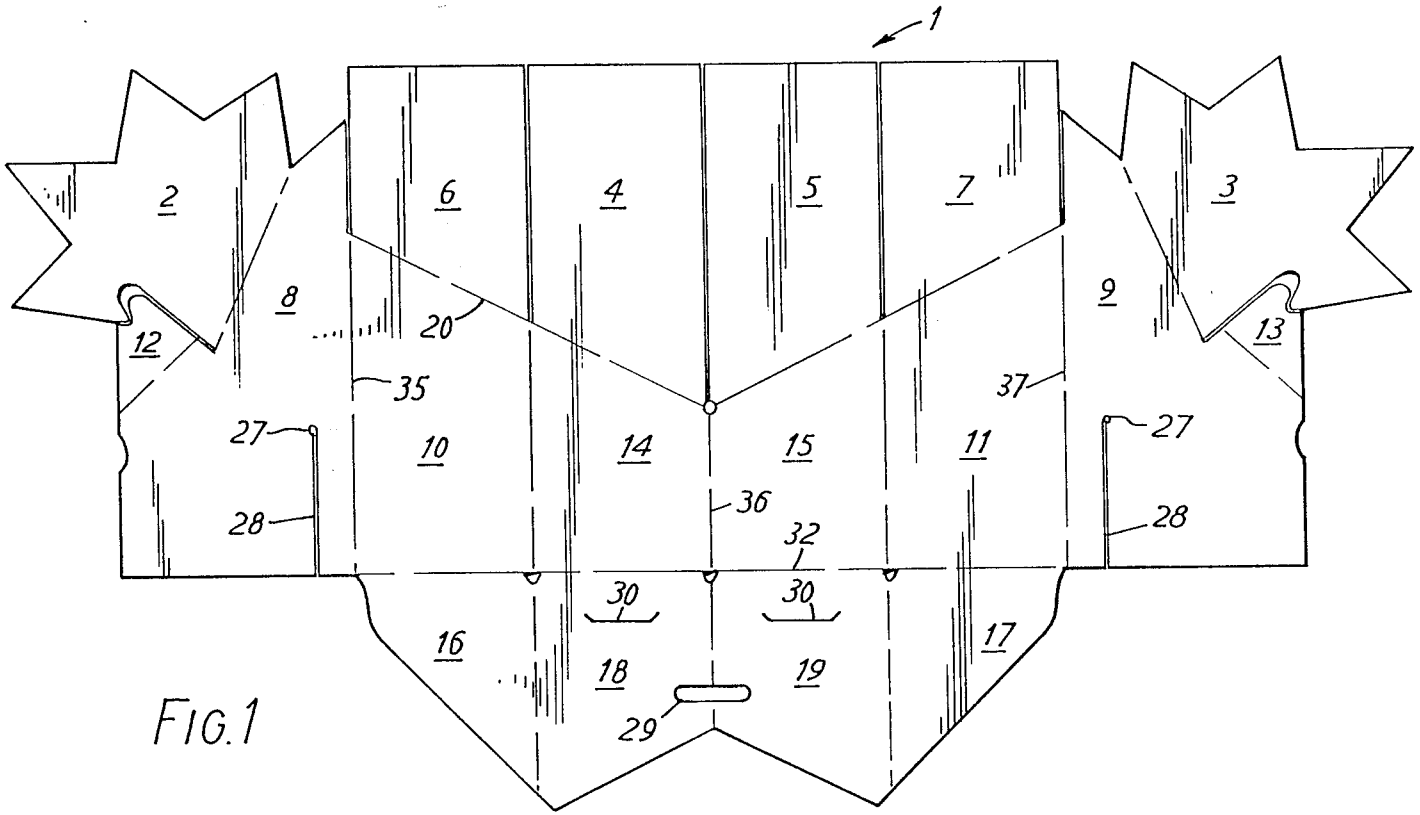
FIG. 1 shows a blank for a lamina for a first form of greeting card.
Figure 2:
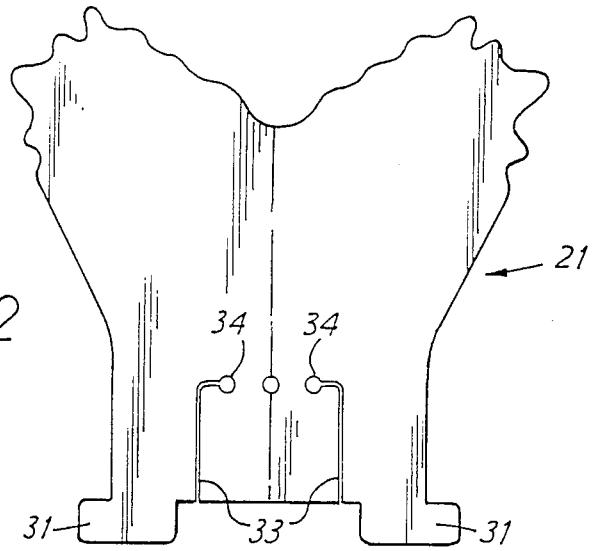
FIG. 2 shows a blank for an auxiliary lamina for cooperation with the aforesaid lamina.

It will be noted from FIG. 4 that the plinth 25 is of a substantially square cross-section and that it comprises a diagonal web 26 which is made up of portions 8 and 9 which are contiguously disposed in adjacent planes; the rubber band 22 is anchored in enlarged bights 27 in slots 28 in the said portions 8 and 9 (FIG. 1).

The auxiliary lamina 21, apart from contributing to the decorative display, is provided to facilitate assembly of the greeting card, and more particularly the insertion of the rubber band 22. It is hooked into slots 30 in the blank 1 by lugs 31 and lies flush against the portions 14 and 15 of the blank 1, nesting between the latter and portions 18 and 19 of the blank 1 which have been turned up about the fold line 32. The rubber band 22, having been inserted into slots 33 so as to rest in holes 34 in the auxiliary lamina 21, is then threaded through a slot 29 bridging the portions 18 and 19. Finally, with the blank 1 folded about the fold lines 35 to 37, the rubber band 22 is slipped through said slots 28 into the said bights 27.

The array of portions which defines the display 24 may take any desired decorative form. In the embodiment shown in FIGS. 1 to 4, the display 24 comprises a set of four flaps coated in tin foil and defined by the portions 4 to 7; another part of the display 24 comprises the star-shaped portions 2 and 3.

It will be appreciated that the desired message or greeting is printed on or across one or more of the portions defining the said display.

Figure 6:
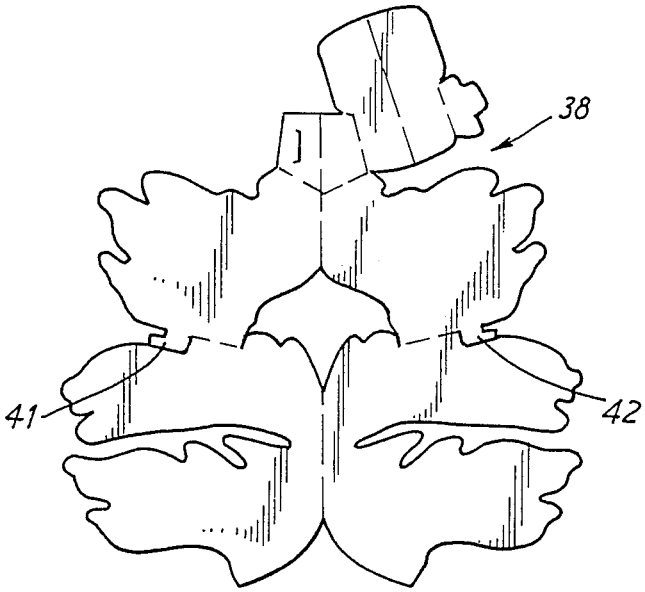
FIG. 6 shows a blank for a second lamina for said second form of greeting card.
Figure 5:
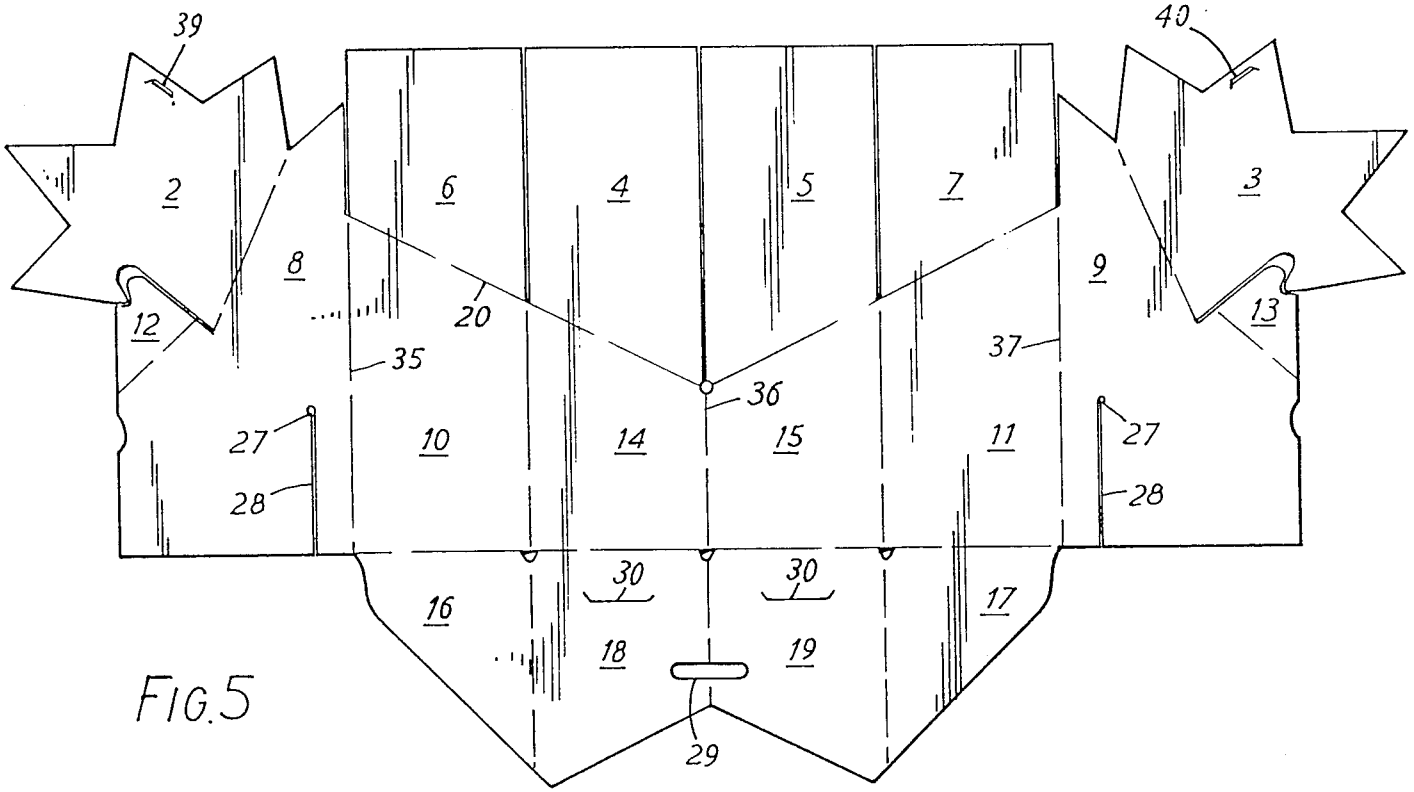
FIG. 5 is a view corresponding to FIG. 1 of a blank for a first lamina of a said second form of greeting card.
Figure 7:
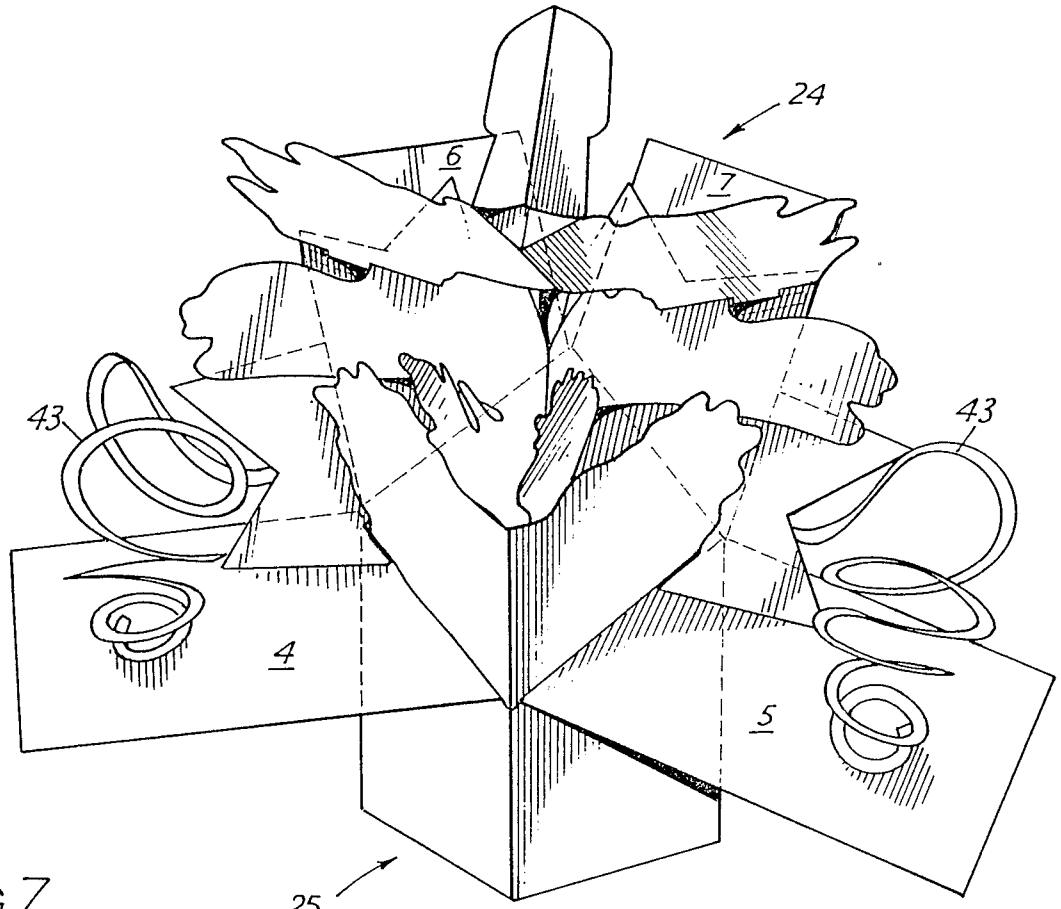
FIG. 7 is a perspective view corresponding to FIG. 4 but from above of said second form of greeting card.

Referring now to FIGS. 5 to 7 (viz. those illustrating a second form of greeting card) the same reference numerals are used as those for corresponding parts of the greeting card illustrated in FIGS. 1 to 4.

The blank shown in FIG. 5 differs from that shown in FIG. 1 only in that a slot is provided in each of portions 2 and 3 into which a second lamina, a blank for which is shown in FIG. 6 and which is generally designated 38, is hooked. The said slots are numbered respectively 39 and 40 and hooks 41, 42 on the second lamina 38 are respectively hooked into the slots 39 and 40.

Ornamental strips 43 are attached to appropriate ones of portions 2 to 7 (FIG. 7). For sake of clarity these have been omitted from FIG. 4.

When folded for insertion in, and prior to its removal from, an envelope 23, this second form of greeting card looks the same as the first form of greeting card (viz. as shown in FIG. 3). However, with the portions 2 to 19 in the said second relative position, this second form of greeting card looks as shown in FIG. 7, the portions of the lamina made of the blank 38 having been urged by the rubber band 22 into the position shown, (via adjacent ones of the portions 2 to 7) in which the portions of the second lamina define a second display which extends three-dimensionally from the display 24.

The material of the laminae may be 130–330 grams/-square meter, and preferably 180–280 grams/square meter, glazed card and, as those skilled in the art will appreciate, it is important that the direction of the grain of the material is such that the desired resilience of the relevant portions about their fold lines is achieved.

I claim:

1. A greeting card comprising a lamina having portions which are foldable with respect to each other; resilient means for urging said portions of such a folded lamina from a first relative position in which said portions are contiguously disposed in adjacent planes into a second relative position in which said portions are disposed in mutually transverse planes and a first array of said portions defines a display surmounting, and extending three-dimensionally from, a second array of said portions which defines a plinth for said first array; and a second lamina having portions which are foldable with respect to each other, said second lamina being secured to said first-mentioned lamina so that, in said first relative position of said portions of said first-mentioned lamina, said portions of said second lamina are folded so that said last-mentioned portions are disposed in a first relative position in which they are contiguously disposed in adjacent planes and, in said second relative position of the portions of said first-mentioned lamina, said portions of said second lamina are urged by said resilient means, directly or via at least one portion of said first-mentioned lamina into a second relative position in which said portions of said second lamina define a second display which extends three-dimensionally from the display defined by said array of said portions of said first-mentioned lamina.

2. A greeting card according to claim 1 including an auxiliary lamina which is arranged to contribute to said display and adapted to facilitate assembly of the greeting card by facilitating the insertion of a rubber band defining said resilient means, said auxiliary lamina being attached to said first-mentioned lamina.

3. A greeting card according to claim 2 wherein said second lamina and said auxiliary lamina have lugs whereby the lugs are hooked into slots in said first-mentioned lamina.

4. A greeting card according to claim 1 wherein, in said second relative position, said plinth is of a substantially square cross-section and comprises a diagonal web made up of portions of said first-mentioned lamina.

5. A greeting card according to claim 1 wherein at least one ornamental strip is attached to, so as to extend between, portions of said lamina.

6. A greeting card according to claim 1 comprising a set of flaps coated in tin foil.

7. A greeting card according to claim 1 wherein the material of said laminae is 130 to 330 grams/square meter glazed card.

8. A greeting card as recited in claim 1 comprising a flat envelope for surrounding the greeting card and maintaining the portions of the folded lamina in the first relative position.

9. A greeting card according to claim 1 wherein at least one ornamental strip is attached to, so as to extend between, portions of said laminae.

10. A greeting card comprising a first lamina (1) having portions which are foldable with respect to each other, a plinth portion of said lamina comprising four adjacent wall panels (10, 11, 14, 15) separated by parallel fold lines for folding between a flattened position in two planes and an erected position in a parallelogram, a pair of stiffening web panels (8, 9) adjacent to two of the wall panels (10, 11) and separated therefrom by parallel fold lines for folding between a flattened position between the wall panels and an erected position extending in face-to-face engagement diagonally across the parallelogram, resilient means (22) for urging opposite edges of the parallelogram plinth towards each other and against opposite edges of the stiffening web panels, and a plurality of display panels (2 to 7) extending from the wall panels and separated therefrom by fold lines for folding between a flattened position in planes parallel to said two planes and an erected position extending three-dimensionally from the plinth portion to form a display.

11. A greeting card as recited in claim 10 wherein the resilient means comprises a rubber band encircling the diagonal stiffening web panels.

12. A greeting card as recited in claim 10 comprising a second lamina (21) secured to the first lamina having a plurality of panels foldable with respect to each other between a folded position in which the portions are in contiguous planes and an erected position in which at least some of said portions of the second lamina extend three-dimensionally from the display panels to form a second display.

13. A greeting card as recited in claim 10 comprising a second lamina (21) having a pair of intermediate panels separated by a fold line, each of the intermediate panels being fitted between a wall panel (10, 11, 14, 15) and an inside panel (16 to 19) foldably connected to a respective wall panel along a fold line perpendicular to the fold lines between adjacent wall panels.

* * * * *